US008971730B2

(12) United States Patent
Shibuya et al.

(10) Patent No.: US 8,971,730 B2
(45) Date of Patent: Mar. 3, 2015

(54) IMAGE FORMING APPARATUS AND CARTRIDGE

(71) Applicant: Canon Kabushiki Kaisha, Tokyo (JP)

(72) Inventors: Ryota Shibuya, Yokohama (JP); Minoru Kawanishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/085,904

(22) Filed: Nov. 21, 2013

(65) Prior Publication Data

US 2014/0153936 A1 Jun. 5, 2014

(30) Foreign Application Priority Data

Nov. 30, 2012 (JP) ..... 2012-262016

(51) Int. Cl.
*G03G 15/00* (2006.01)
*G03G 21/18* (2006.01)

(52) U.S. Cl.
CPC ..... *G03G 21/1892* (2013.01)
USPC ..... 399/13; 399/90

(58) Field of Classification Search
CPC ..... G03G 21/1892
USPC ..... 399/13, 90
See application file for complete search history.

(56) References Cited

U.S. PATENT DOCUMENTS 6,201,935 B1 * 3/2001 Terada et al. ..... 399/13
6,311,026 B1 * 10/2001 Higeta et al. ..... 399/13
6,343,192 B1 * 1/2002 Miyabe et al. ..... 399/13

FOREIGN PATENT DOCUMENTS

JP 2000-194246 A 7/2000
JP 2002-333798 A 11/2002
JP 2009-265345 A 11/2009

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus to which a cartridge including first and second cartridge contacts is detachably mountable, includes: a guiding member for guiding the cartridge to a positioning portion provided in a main assembly of the image forming apparatus; a first main assembly contact contactable to the first cartridge contact when the cartridge is positioned partway toward the positioning portion and is positioned in the positioning portion; a second main assembly contact contactable to the second cartridge contact when the cartridge is positioned partway toward the positioning portion; a third main assembly contact contactable to the second cartridge contact only when the cartridge is positioned in the positioning portion; and a control portion for detecting presence or absence of the cartridge in the main assembly and a mounted state of the cartridge by being electrically connected with the first, second and third main assembly contacts.

11 Claims, 7 Drawing Sheets

(a)

(b)

IMAGE FORMING APPARATUS AND CARTRIDGE

FIELD OF THE INVENTION AND RELATED ART

The present invention relates to an image forming apparatus, such as a copying machine, a printer or a facsimile machine, having a function of forming an image on a recording material such as a sheet, and relates to a cartridge detachably mountable to the image forming apparatus.

An electrophotographic image forming apparatus forms the image on the recording material by an electrophotographic image forming process using a photosensitive drum and a transfer roller. In a constitution of an image forming portion for forming the image on the recording material, a process cartridge type in which a photosensitive member and process means actable on the photosensitive member are integrally assembled into a cartridge which is detachably mountable to an image forming apparatus main assembly is employed. According to the process cartridge type, maintenance of the image forming apparatus can be performed by a user himself (herself) irrespective of a service person, and therefore it is possible to remarkably improve operativity (operability). For this reason, the process cartridge type has been widely used in the image forming apparatus.

In the process cartridge type, when the process cartridge is demounted from and mounted into the image forming apparatus main assembly, it is desired that operativity of the cartridge is facilitated. In a conventional constitution, as one of means for facilitating the operativity, when the process cartridge is mounted into the image forming apparatus main assembly, complete mounting of the process cartridge into the apparatus main assembly is detected. That is, a constitution in which the process cartridge is electrically connected with an electrical contact when the process cartridge reaches a mounting position thereof is employed, and the electrical contact is connected with a mounting detecting means, provided in the image forming apparatus main assembly, for detecting presence or absence of the process cartridge (Japanese Laid-Open Patent Application (JP-A) 2000-194246).

However, in the above-described conventional constitution, there was the following problem.

There is a possibility that when the cartridge is mounted into the apparatus main assembly, friction generated between the apparatus main assembly and the cartridge and a spring provided in an apparatus main assembly side in order to determine a position of the cartridge constitute a resistance during insertion of the cartridge.

Further, in the case where a mounting locus of the cartridge is not a rectilinear line due to constrains such as a space and position of the cartridge in the apparatus main assembly, an inserting direction of the cartridge is changed in partway. In these constitutions, when an operator mounted the cartridge into the apparatus main assembly, there was a possibility that the cartridge was placed in an incompletely mounted state in which the cartridge is not completely mounted in a positioning portion in the apparatus main assembly.

SUMMARY OF THE INVENTION

The present invention is accomplished for solving the above-described problem. A principal object of the present invention is to provide an image forming apparatus having improved usability during demounting and mounting and during exchanging of the cartridge by detecting an incompletely mounted state of the cartridge.

According to an aspect of the present invention, there is provided an image forming apparatus to which a cartridge including a first cartridge contact and a second cartridge contact is detachably mountable, comprising: a guiding member for guiding the cartridge to a positioning portion provided in a main assembly of the image forming apparatus; a first main assembly contact contactable to the first cartridge contact when the cartridge is positioned partway toward the positioning portion and is positioned in the positioning portion; a second main assembly contact contactable to the second cartridge contact when the cartridge is positioned partway toward the positioning portion; a third main assembly contact contactable to the second cartridge contact only when the cartridge is positioned in the positioning portion; and detecting means for detecting presence or absence of the cartridge in the main assembly and a mounted state of the cartridge by being electrically connected with the first, second and third main assembly contacts.

These and other objects, features and advantages of the present invention will become more apparent upon a consideration of the following description of the preferred embodiments of the present invention taken in conjunction with the accompanying drawings.

Figure 3:
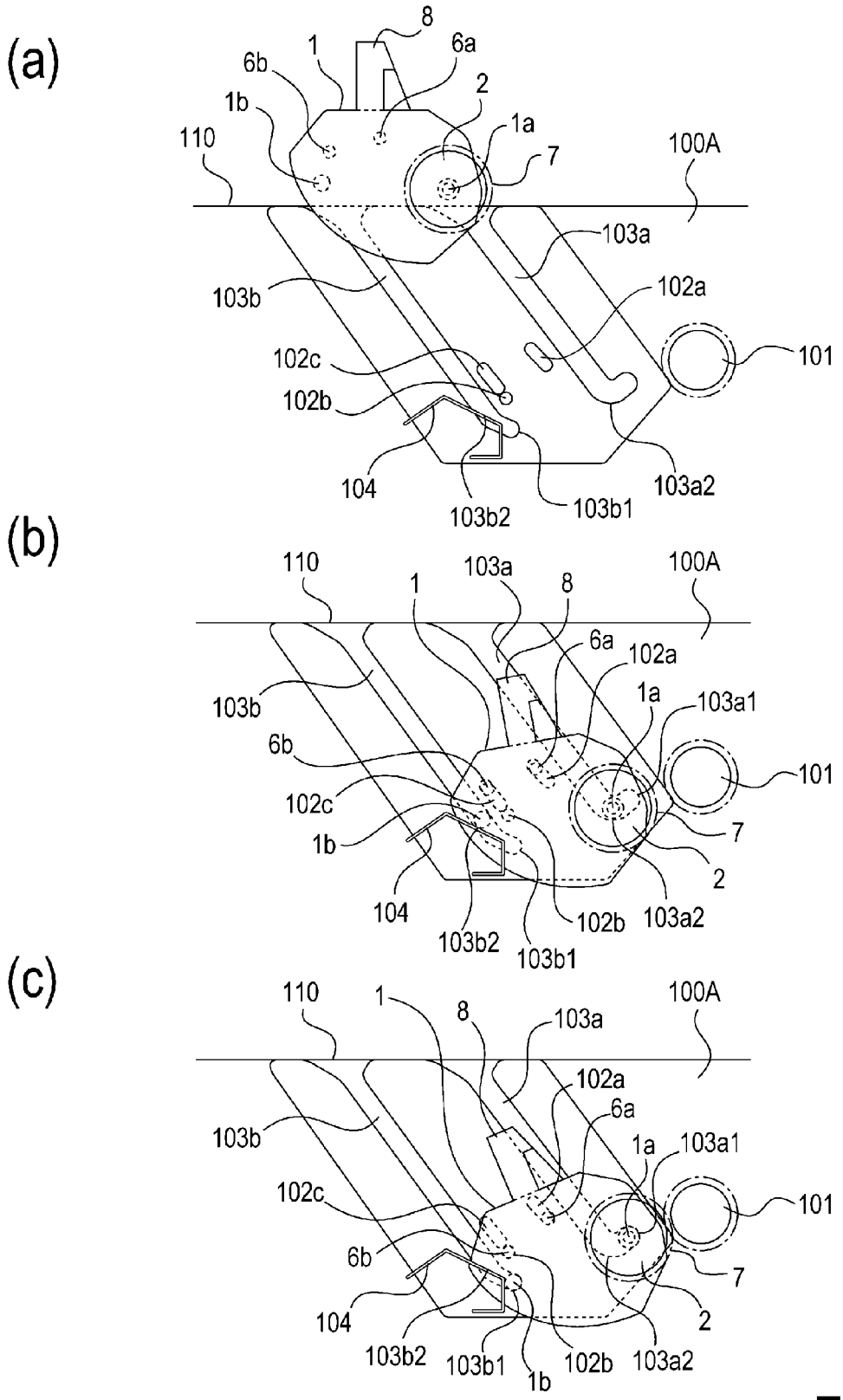

Parts (a) to (c) of FIG. 3 are schematic views showing a mounting state of the cartridge in First Embodiment, in which (a) shows an unmounted state immediately before the cartridge is inserted into an apparatus main assembly, (b) shows an incompletely mounted state of the cartridge into the apparatus main assembly, and (c) shows a connect mounted state of the cartridge in the apparatus main assembly.

Figure 4:
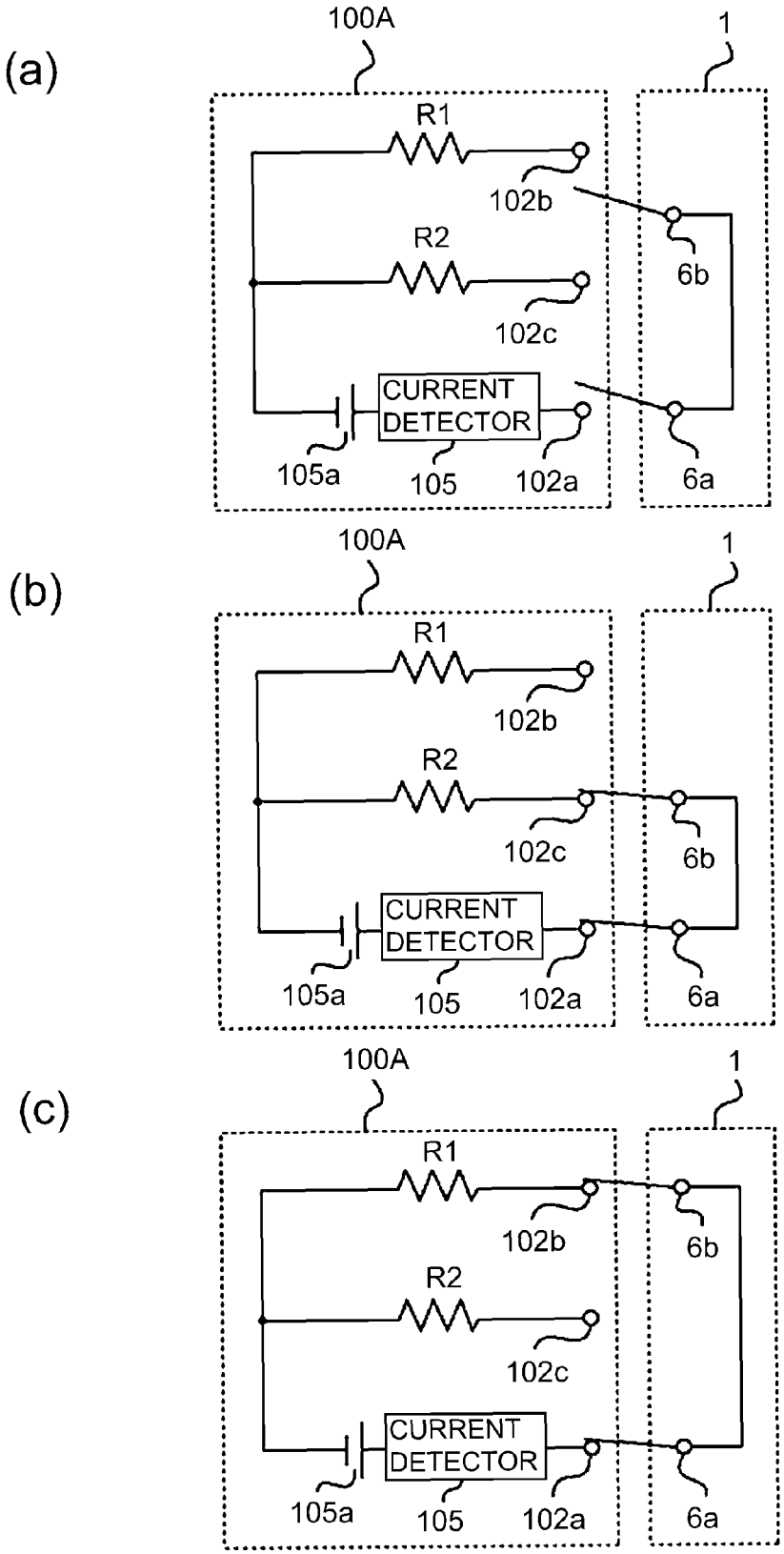

Parts (a) to (c) of FIG. 4 are schematic views showing a circuit structure of a detecting system in First Embodiment, in which (a) shows the circuit structure in an unmounted state immediately before the cartridge is inserted into an apparatus main assembly, (b) shows a circuit structure in an incompletely mounted state of the cartridge into the apparatus main assembly, and (c) shows a circuit structure in a connect mounted state of the cartridge in the apparatus main assembly.

Figure 5:
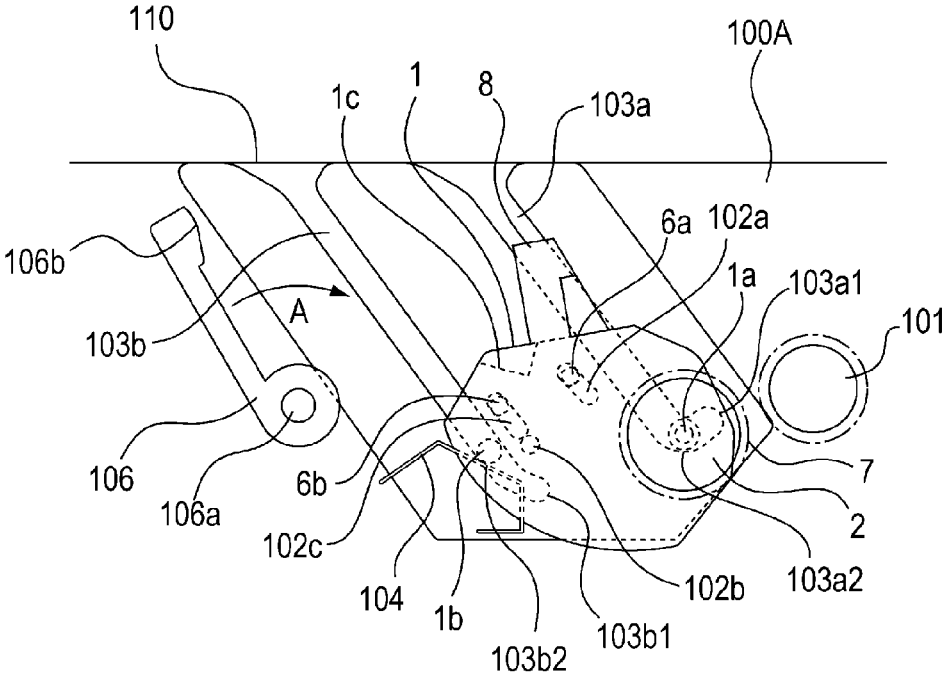
Figure 5:
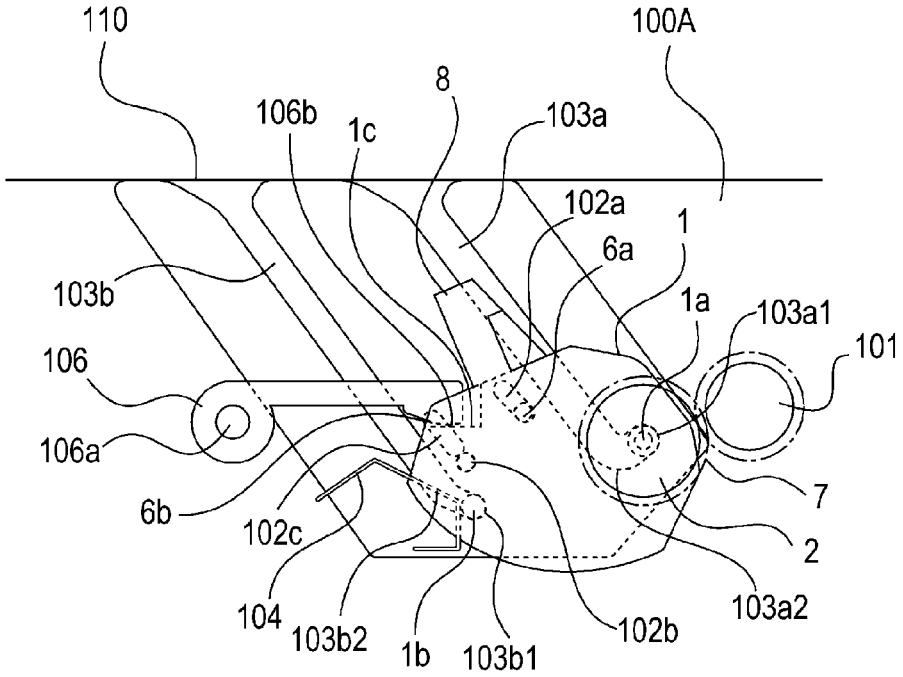

Parts (a) and (b) of FIG. 5 are schematic views showing an operation of an apparatus main assembly when an incompletely mounted state of a cartridge in Second Embodiment is detected, in which (a) shows the incompletely mounted state of the cartridge into the apparatus main assembly, and (b) shows a connect mounted state of the cartridge in the apparatus main assembly.

Figure 6:
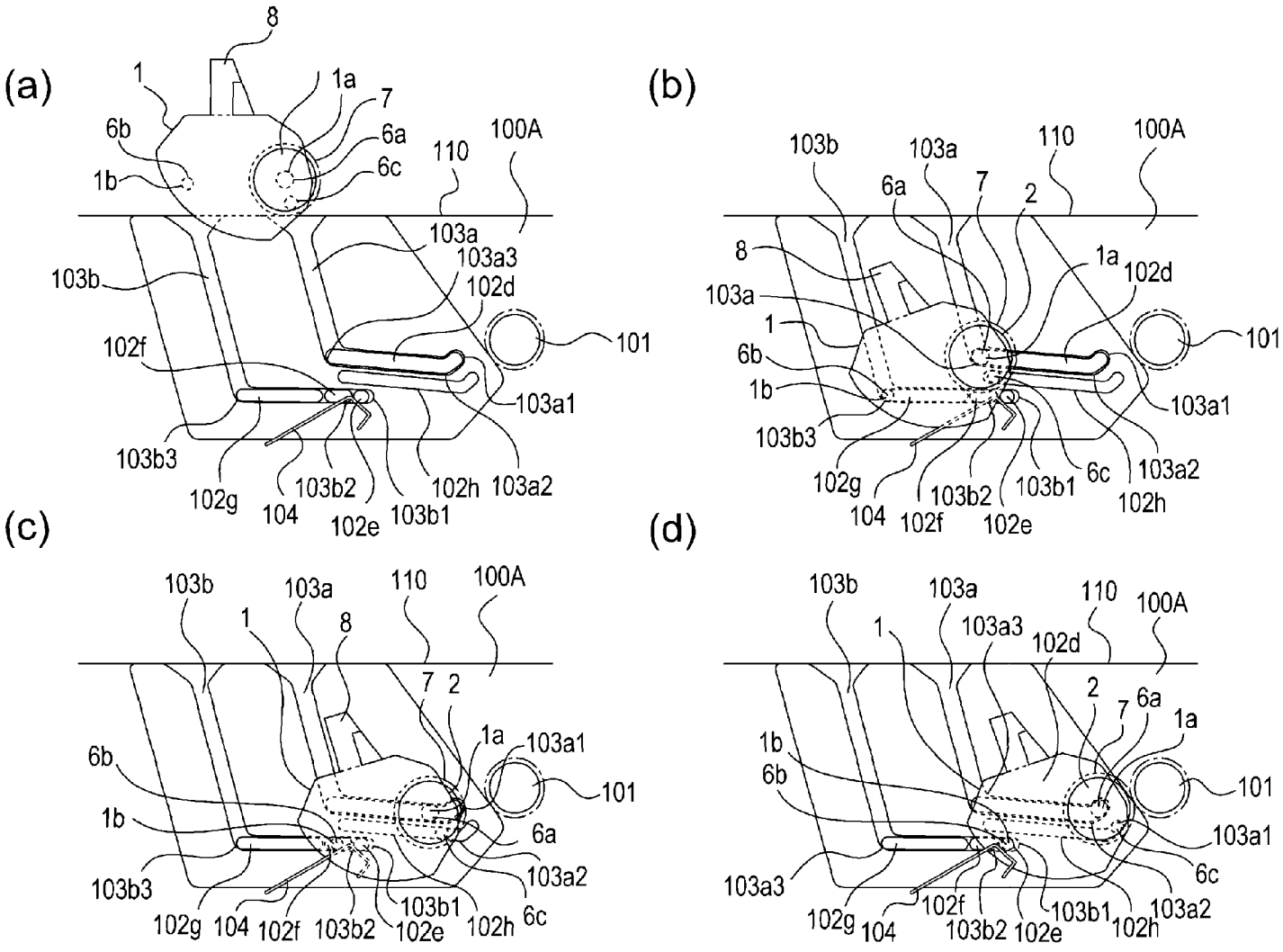

Parts (a) to (d) of FIG. 6 are schematic views showing a mounting state of a cartridge in Third Embodiment, in which (a) shows an unmounted state immediately before the cartridge is inserted into an apparatus main assembly, (b) shows an incompletely mounted state of the cartridge into the apparatus main assembly in the neighborhood of a bent portion of a cartridge guide, (c) shows an incompletely of the cartridge into the apparatus main assembly in front of a complete mounting position, and (d) shows a completely mounted state of the cartridge in the apparatus main assembly.

Figure 7:
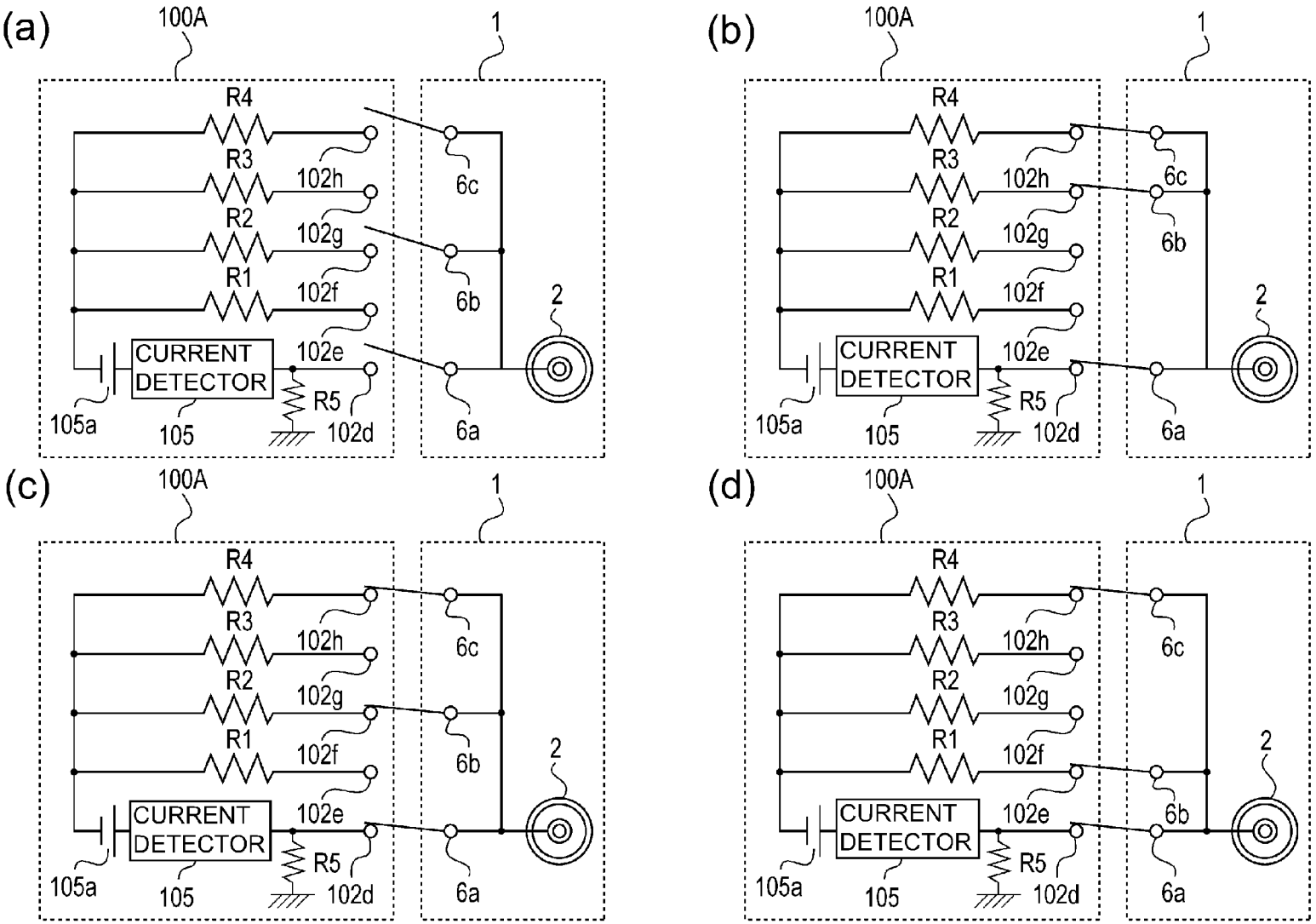

Parts (a) to (d) of FIG. 7 are schematic circuit views showing a structure of a detecting system in Third Embodiment, in which (a) shows an unmounted state of the cartridge, (b) shows a second incompletely mounted state of the cartridge, (c) shows a first incompletely mounted state of the cartridge, and (d) shows a completely mounted state of the cartridge.

DESCRIPTION OF THE EMBODIMENTS

With reference to the drawings, preferred embodiments of the present invention will be specifically described below. However, dimensions, materials, shapes and relative arrangement of constituent elements described in the following embodiments should be appropriately changed depending on structure and various conditions of devices (apparatuses) to which the present invention is to be applied, and therefore the scope of the present invention is not intended to be limited to the following embodiments.

First Embodiment

An image forming apparatus according to First Embodiment of the present invention will be described. Incidentally, in this embodiment, as the image forming apparatus, a laser beam printer to which a process cartridge is detachably mountable is exemplified.

(General Structure of Image Forming Apparatus)

Figure 1:
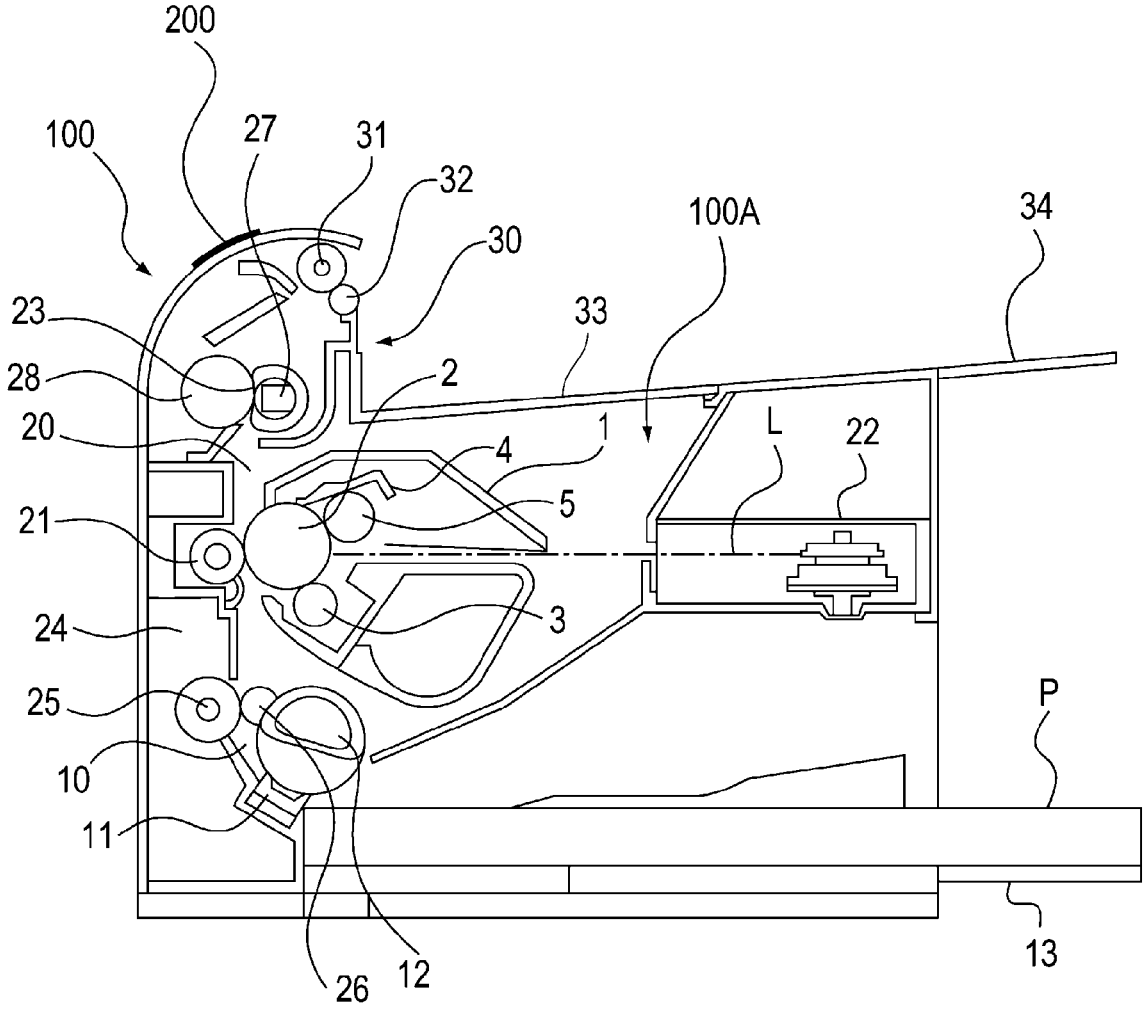
FIG. 1 is a schematic sectional view showing a structure of an image forming apparatus in First Embodiment.

FIG. 1 is a schematic view showing a cross section of a general structure of an image forming apparatus 100. As shown in FIG. 1, the image forming apparatus 100 includes a feeding portion 10, an image forming portion 20 and a discharging portion 30.

The image forming portion 20 includes a cartridge 1 which is detachably mountable to an apparatus main assembly 100A of the image forming apparatus 100 and which performs a part of an image forming process, a transfer roller 21 for transferring an image onto a recording material P, a laser exposure device 22 for irradiating a photosensitive member with laser light, a fixing device 23 for heat-fixing the recording material P, and the like.

The cartridge 1 includes a photosensitive drum 2 (photosensitive member) on which an electrostatic latent image is to be formed by being irradiated with laser light L from the laser exposure device 22. Further, the cartridge 1 includes a developing means for developing the electrostatic latent image on the photosensitive drum 2, a cleaning member 4 for removing a developer from the photosensitive drum 2, and a charging means 5 for electrically charging the photosensitive drum 2. Further, the photosensitive drum 2 carries a toner image developed from the electrostatic latent image by the developing means 3.

The feeding portion 10 includes a feeding roller 12 and a separating pad 11 which are used for separating and feeding sheets of the recording material P, one by one, accommodated in a feeding tray 13. The recording material P fed by the feeding portion 10 is sent to the image forming portion 20 by conveying rollers 25 and 26 held by a conveying frame 24, and in the image forming portion 20, the toner image formed on the photosensitive drum 2 is transferred by the transfer roller 21.

The recording material P having finished the transfer of the toner image is conveyed to a fixing device 23 constituted by a heating unit 27 and a pressing roller 28, and in the fixing device 23, the transferred toner image is heated and fixed. Thereafter, the recording material P is discharged to the discharge portion 30, constituted by a discharge tray 33 and an extended discharge tray 34, by discharging rollers 31 and 32.

(Structure of Cartridge)

Figure 2:
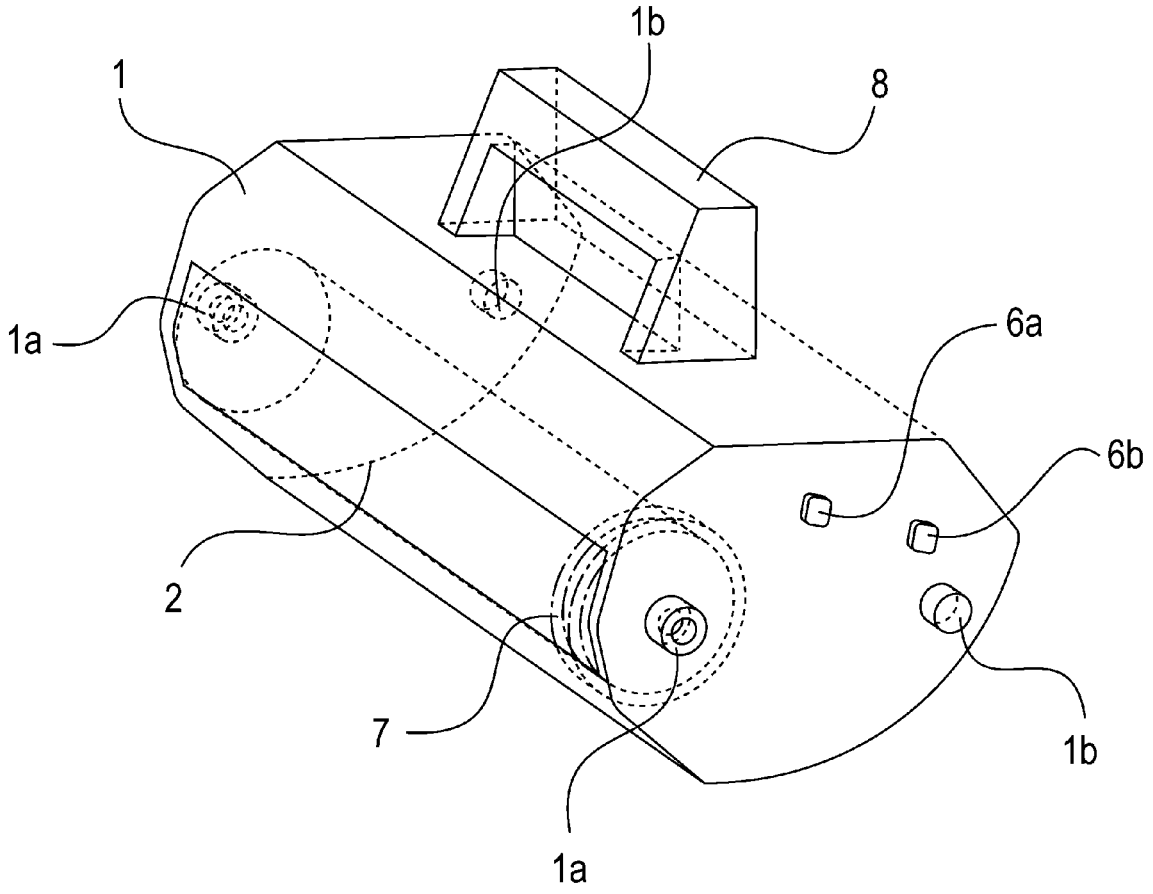
FIG. 2 is a perspective view showing an outer appearance of a cartridge in First Embodiment.

FIG. 2 is a perspective view of an outer appearance of the cartridge 1 of the image forming apparatus 100 shown in FIG. 1. As shown in FIG. 2, in a longitudinal end side and another longitudinal end side of the cartridge 1, boss 1*a* as a portion-to-be-positioned for determining an attitude of the cartridge 1 in the apparatus main assembly 100A are provided, respectively, and boss 1*b* as a rotation-limiting portion are provided, respectively.

Further, on the surface of the cartridge 1 in the L end side, an electrical contact 7*a* located close to the boss 1*a* and an electrical contact 6*b* (cartridge-side electrical contact) located close to the boss 1*b* are provided. Further, the electrical contacts 6*a* and 6*b* are electrically contacted to associated electrical contacts (described later) in an apparatus main assembly 100A side depending on a mounted state of the cartridge 1 to establish (electrical) continuity.

Further, at an end portion of the photosensitive drum 2 provided in the cartridge 1, a drum gear 7 for rotationally driving the photosensitive drum 2 is fixed. Further, the cartridge is provided with a grip portion for facilitating demounting and mounting of the cartridge 1 is provided, and is gripped to perform the demounting and mounting of the cartridge 1.

(Mounting of Cartridge)

Parts (a) to (c) of FIG. 3 are schematic views showing a positioning portion of the cartridge 1 and the neighborhood thereof when the image forming apparatus 100 is viewed from a longitudinal direction of the cartridge 1. A cross section in each of the figures is a plane which is perpendicular to the longitudinal direction of the cartridge 1 and which passes through a central portion of the apparatus main assembly 100A.

Part (a) of FIG. 3 shows an unmounted state immediately before the cartridge 1 is inserted into the apparatus main assembly 100A, (b) of FIG. 3 shows an incompletely mounted state of the cartridge 1 into the apparatus main assembly 100A, and (c) of FIG. 3 shows a completely mounted state of the cartridge 1 in the apparatus main assembly 100A.

Left and right side plates of the apparatus main assembly 100A is provided with a cartridge guide 103*a* (guide passage) for guiding the boss 1*a* of the cartridge 1 into the completely mounted state and a cartridge guide 103*b* (guide passage) for guiding the boss 1*b* of the cartridge 1 into the completely mounted state are provided, respectively. Further, at a deepest portion of the cartridge guide 103*a*, a positioning portion 103*a*1 to be engaged with the boss 1*a* when the cartridge 1 is completely mounted into the apparatus main assembly 100A is provided. Further, at a deepest portion of the cartridge guide 103*b*, a main assembly rotation-limiting portion 103*b*1 to be contacted to the boss 1*b* when the cartridge 1 is completely mounted into the apparatus main assembly 100A is provided.

When the cartridge 1 is inserted toward an inside of the apparatus main assembly 100A through an opening 110, the bosses 1*a* and 1*b* are moved along the cartridge guides 103*a* and 103*b* to contact the positioning portion 103*a*1 and the main assembly rotation-limiting portion 103*b*1, respectively. Accordingly, movement locus and attitude of the cartridge 1 in the apparatus main assembly 100A are determined by shapes of the cartridge guides 103*a* and 103*b*.

Further, as shown in (c) of FIG. 3, when the cartridge 1 is completely mounted in the apparatus main assembly 100A, a driving gear 101 for transmitting a driving force from a driving source provided in the apparatus main assembly 100A is connected with the drum gear 7, so that the driving force is transmitted to the cartridge 1.

In an intermediate position of the cartridge guide 103*b* when the cartridge 1 is mounted into the apparatus main assembly 100A, a wire spring 104 as an urging means for bringing the boss 1*b* into contact with the main assembly rotation-limiting portion 103*b*1 is provided. The wire spring 104 urges the boss 1*b* so as not to be demounted from a mounting position in the completely mounted state of the cartridge 1. However, when the cartridge 1 is inserted into the apparatus main assembly 100A, the wire spring 104 constitutes an obstacle to the insertion of the boss 1*b*, and therefore the boss 1*b* is liable to stop in an incompletely mounted position where the boss 1*b* contacts the wire spring 104 toward the opening 110.

Further, a shape of the cartridge guide 103*a* is not a straight shape but is bent in partway of the mounting of the cartridge 1. For that reason, also an insertion direction of the cartridge 1 is changed in partway, so that the boss 1*a* is liable to stop in an incompletely mounted position 103*a*2. Accordingly, the boss 1*a* stops in the incompletely mounted position 103*a*2 and the boss 1*b* stops in the incompletely mounted position 103*b*2, so that the cartridge 1 is placed in the incompletely mounted state in some cases as shown in (b) of FIG. 3.

In the end side of the side plate of the apparatus main assembly 100A, electrical contacts 102*a* and 102*b* (apparatus main assembly-side electrical contact) disposed so as to electrically contact the cartridge 1-side electrical contacts 6*a* and 6*b*, respectively, and an electrical contact 102*c* (apparatus main assembly-side electrical contact) are provided.

Next, connection of the cartridge 1-side electrical contacts with the apparatus main assembly 100A-side electrical contacts in the mounted state of the cartridge 1 will be described.

In the completely mounted state shown in (c) of FIG. 3, the electrical contacts are disposed so that the cartridge 1-side electrical contact 6*a* and the apparatus main assembly 100A-side electrical contact 102*a* are electrically in contact with each other and so that the cartridge 1-side electrical contact 6*b* and the apparatus main assembly 100A-side electrical contact 102*b* are electrically in contact with each other.

In the incompletely mounted state shown in (b) of FIG. 3, the electrical contacts are disposed so that the cartridge 1-side electrical contact 6*a* and the apparatus main assembly 100A-side electrical contact 102*a* are electrically in contact with each other and so that the cartridge 1-side electrical contact 6*b* and the apparatus main assembly 100A-side electrical contact 102*c* are electrically in contact with each other.

Further, when the cartridge 1-side electrical contact 6*b* is located between the apparatus main assembly 100A-side electrical contacts 102*b* and 102*c*, the wire spring 104 is disposed so as to urge the boss 1*b* toward the apparatus main assembly rotation-limiting portion 103*b*1. For that reason, the cartridge 1 is prevented from stopping in a position the incompletely mounted state (position) and the completely mounted state (position).

(Structure of Detecting Circuit of Mounted State of Cartridge)

Parts (a) to (c) of FIG. 4 are circuit diagrams for detecting the mounted state of the cartridge in this embodiment.

Part (a) of FIG. 4 shows a circuit structure of a detecting system in the unmounted state of the cartridge 1, (b) of FIG. 4 shows the detecting system circuit structure in the incompletely mounted state of the cartridge 1, and (c) of FIG. 4 shows the detecting system circuit structure in the completely mounted state of the cartridge 1.

In this embodiment, as a cartridge mounting detecting system (mounted state-detecting means) for detecting the mounted state of the cartridge 1, a circuit for detecting the mounted state of the cartridge 1 is provided in the apparatus main assembly 100A.

The detecting circuit is, as shown in FIG. 4, provided with the electrical contacts 102*a*, 102*b* and 102*c* in the apparatus main assembly 100A side. With the electrical contacts 102*b* and 102*c*, ends of resistors R1 and R2 are connected, respectively. Other ends of the resistors R1 and R2 are connected with a negative electrode of a DC power source 105*a*. A positive electrode of the DC power source 105*a* is connected with a terminal of a current detecting portion 105, and the other terminal of the current detecting portion 105 is connected with the electrical contact 102*a*. Further, resistance values of the resistors R1 and R2 are set so as to be different from each other.

The current detecting portion 105 detects a current passing through the circuit and sends a detection result to a controller (not shown) of the apparatus main assembly 100A. Specifically, e.g., the resistor is provided in series in the circuit and then the current is measured by reading voltage drop of the resistor by an AD converter or a comparator, so that a measured current value is set to the controller.

In the cartridge 1 side, the electrical contacts 6*a* and 6*b* are provided and are electrically connected with each other inside the cartridge 1.

In the case where the cartridge 1 is in the unmounted state, as shown in (a) of FIG. 4, all the electrical contacts are in an open state, so that the detecting circuit is not in a closed state and therefore the current does not flow through the current detecting portion 105.

In the case where the cartridge 1 is in the incompletely mounted state, as shown in (b) of FIG. 4, the electrical contact 6*a* and the electrical contact 102*a* are electrically connected with each other, and the electrical contact 6*b* and the electrical contact 102*c* are electrically connected with each other. The resistor R2 is connected in series, and therefore a current value corresponding to the resistance value of the resistor R2 is detected by the current detecting portion 105.

On the other hand, in the case where the cartridge 1 is in the completely mounted state, as shown in (c) of FIG. 4, the electrical contact 6*a* and the electrical contact 102*b* are electrically connected with each other, and the electrical contact 6*b* and the electrical contact 102*c* are electrically connected with each other. The resistor R1 is connected in series, and therefore a current value corresponding to the resistance value of the resistor R1 is detected by the current detecting portion 105. Incidentally, the electrical resistance values of the resistors R1 and R2 are different from each other, and therefore it is possible to detect the mounted state of the cartridge 1 by detecting the current value of the current detecting portion 105.

As described above, the detection of the mounted state of the cartridge 1 is made by detecting the value of the current passing through the current detecting portion 105, so that it becomes possible to discriminate whether the mounted state of the cartridge 1 is the unmounted state, the incompletely mounted state or the completely mounted state.

Incidentally, in this embodiment, the reason why a difference in voltage value is not detected but a difference in current value is detected is as follows. That is, in the image forming apparatus 100, the photosensitive drum 2 is electrically charged to a high voltage by the charging means 5, so that there is a high possibility that static electricity is generated also in many places in the image forming apparatus 100. If a constitution in which the voltage value is measured is employed, there is a possibility that the detecting circuit causes malfunction by the static electricity. The static electricity is high in voltage but is slight in current. Therefore, in this embodiment, a constitution in which the current is measured and thus the detecting circuit is not readily influenced by the static electricity is employed.

(Display of Warning to User)

When the cartridge 1 is in the unmounted state or the incompletely mounted state, the controller (process executing means) of the image forming apparatus 100 displays warning to the user.

When the cartridge 1 is in the unmounted state or the incompletely mounted state, warning is displayed on a displaying portion provided on an operating panel 200 (FIG. 1), so that a message to that effect is notified to the user.

For example, in the case where the unmounting of the cartridge 1 is detected, a message to the effect that there is no cartridge and that the mounting of the cartridge 1 is urged is displayed. Further, in the case where the incompletely mounted state of the cartridge 1 is detected, a message to the effect that the cartridge 1 is not completely mounted and that strong pushing-in of the cartridge is urged is displayed.

In this way, the mounted state of the cartridge is displayed on the operating panel 200, and therefore it is possible to avoid a status in which the user does not aware of the incompletely mounted state of the cartridge 1 and discriminates that the image forming apparatus 100 causes malfunction.

Incidentally, without displaying the warning on the operating panel 200 by using the message, a light-emitting diode for the warning may also be turned on.

Further, a signal may also be sent to an external computer to display a message, on the basis of the signal, on a monitor of the computer.

(Other Constitution Examples)

Other constitutions in this embodiment will be described. In this embodiment, the electrical contact 102*a* and the current detecting portion 105 which are connectable in both of the incompletely mounted state and the completely mounted state are provided in the apparatus main assembly 100A side but may also be provided in the cartridge 1 side.

Further, in this embodiment, the electrical contacts 6*a* and 6*b* disposed in the cartridge 1 side are provided as two parts (components) on the cartridge 1 and are connected by the circuit, but an elongated electrical contact can also be provided as a single part in order to reduce the number of parts. Further, this electrical contact may also be disposed so as to connect between the apparatus main assembly-side electrical contacts 102*a* and 102*b* and between the apparatus main assembly-side electrical contacts 102 and 102*c*.

Further, in this embodiment, the electrical contacts 6*a* and 6*b* are provided at the longitudinal end of the cartridge 1, and the apparatus main assembly-side electrical contacts 102*a*, 102*b* and 102*c* are provided in the side of the side plate of the apparatus main assembly 100A. However, the electrical contacts are provided at the longitudinal ends (both ends) of the cartridge 1 and in the sides of the (both) side plates of the apparatus main assembly 100A, so that it becomes possible to detect the mounted state of the cartridge 1 at the longitudinal ends (both ends) of the cartridge 1.

Further, in this embodiment, an example of the case where a single cartridge 1 is provided is described, but even in the case where a plurality of cartridges are provided, by applying the present invention in a similar manner, it is possible to obtain a similar effect with respect to each of the cartridges.

Second Embodiment

Second Embodiment of the image forming apparatus according to the present invention will be described. In this embodiment, an operation after the detection of the incompletely mounted state is different from the operation in First Embodiment. Incidentally, constituent portions (elements) identical or similar to those in First Embodiment are represented by the same reference numerals or symbols and will be omitted from redundant description.

Parts (a) and (b) of FIG. 5 are schematic views, for illustrating an operation of the apparatus main assembly 100A when the incompletely mounted state of the cartridge 1 is detected, showing a positioning portion of the cartridge 1 and the neighborhood thereof when the image forming apparatus 100 is viewed from a longitudinal direction of the cartridge 1 in this embodiment.

In each of these figures, a cross section is a plane which is perpendicular to the longitudinal direction of the cartridge 1 and which passes through a central portion of the apparatus main assembly 100A.

Part (a) of FIG. 5 shows the incompletely mounted state of the cartridge 1 in the apparatus main assembly 100A, and (b) of FIG. 5 shows a completely mounted state of the cartridge 1 in the apparatus main assembly 100A.

A lever 106 (moving means), shown in FIG. 5, provided rotatably about a shaft 106*a* as a rotation center in the apparatus main assembly 100A is rotationally moved in arrow A direction by an unshown driving means when the incompletely mounted state of the cartridge 1 is detected. Then, a contact portion 106*b* of the lever 106 is contacted to a contact portion 1*c* of the cartridge 1 to push the cartridge 1, so that the cartridge 1 is moved from the incompletely mounted state (position) to the completely mounted state (position).

Therefore, when the cartridge 1 is placed in the incompletely mounted state, it becomes possible to move the cartridge 1 to the completely mounted state (position) without troubling the user. Further, when the incompletely mounted state of the cartridge 1 is detected, the lever 106 is moved to an initial position shown in (a) of FIG. 5 by the unshown driving means, and therefore when the cartridge 1 is pulled out, it is possible to smoothly perform demounting and mounting of the cartridge 1.

As a result, the lever 106 is operated only when the cartridge 1 is in the incompletely mounted state, so that an unnecessary operation of the lever 106 in the unmounted state and the incompletely mounted state of the cartridge 1 is avoided.

Incidentally, it is also possible to combine the lever 106 with First Embodiment. That is, on the operation panel 200 in First Embodiment, a message that the cartridge is in the incompletely mounted state and is moved to the completely mounted state (position) may also be displayed.

Third Embodiment

Third Embodiment of the image forming apparatus according to the present invention will be described. In this embodiment, constitutions of the cartridge guide, the electrical contacts and the detecting system are different from those in First Embodiment. Incidentally, constituent portions (elements) identical or similar to those in First Embodiment are represented by the same reference numerals or symbols and will be omitted from redundant description.

(Mounting of Cartridge)

Parts (a) to (d) of FIG. 6 are schematic views showing a positioning portion of the cartridge 1 and the neighborhood thereof when the image forming apparatus 100 in this embodiment is in viewed from a longitudinal direction of the cartridge 1. A cross section in each of the figures is a plane which is perpendicular to the longitudinal direction of the cartridge 1 and which passes through a central portion of the apparatus main assembly 100A.

Part (a) of FIG. 6 shows an unmounted state immediately before the cartridge 1 is inserted into the apparatus main assembly 100A, and (b) of FIG. 6 shows an incompletely mounted state of the cartridge 1 into the apparatus main assembly 100A in the neighborhood of a bent portion of a cartridge guide. Further, (c) of FIG. 6 shows the incompletely mounted state of the cartridge 1 into the apparatus main assembly 100A in front of a completely mounted position, and (d) of FIG. 6 shows a completely mounted state of the cartridge 1 in the apparatus main assembly 100A.

In this embodiment, as shown in FIG. 8, a cartridge guide 103*a* for guiding the boss 1*a* of the cartridge 1 into the completely mounted state and a cartridge guide 103*b* for guiding the boss 1*b* of the cartridge 1 into the completely mounted state are provided in a bent state of an intermediate position.

The cartridge 1 is inserted into the apparatus main assembly 100A through an opening 110. Then, the cartridge guides 103*a* and 103*b* are formed so that the cartridge 1 is lowered by the self weight thereof to naturally move the bosses 1*a* and 1*b* to incompletely mounted positions 103*a*3 and 103*b*3, respectively.

For this reason, as shown in (b) of FIG. 6, the cartridge 1 is stopped in the incompletely mounted positions 103*a*3 and 103*b*3 where the cartridge guides 103*a* and 103*b* are bent. For this reason, in some cases, the cartridge 1 is in the incompletely mounted state in the apparatus main assembly 100A in these positions. This state is hereinafter referred to as a second incompletely mounted state.

Further, as shown in (c) of FIG. 6, similarly as in the case of First Embodiment, the bosses 1*a* and 1*b* are stopped in incompletely mounted positions 103*a*2 and 103*b*2, respectively, so that the cartridge 1 is in the incompletely mounted state in some cases. This state is hereinafter referred to as a first incompletely mounted state.

In this embodiment, the electrical contact 6*a* close to the boss 1*a* and the cartridge 1 and the electrical contact 6*b* close to the boss 1*b* of the cartridge 1 are different from those in First Embodiment, and an electrical contact 6*c* is further provided. As shown in FIG. 6, the electrical contact 6*a* is disposed coaxially with the boss 1*a*, the electrical contact 6*b* is disposed coaxially with the boss 1*b*, and the electrical contact 6*c* is disposed close to the boss 1*a*.

In this embodiment, on one side plate of the apparatus main assembly 100A, electrical contacts 102*d*, 102*e*, 102*f* (apparatus main assembly-side electrical contact), 102*g* (apparatus main assembly-side electrical contact) and 102*h* are provided. Further, on the cartridge 1, the electrical contact 6*a*, 6*b* and 6*c* are disposed.

Next, connection of the cartridge 1-side electrical contacts with the apparatus main assembly-side electrical contacts in the mounted state of the cartridge 1 will be described.

In the completely mounted state shown in (d) of FIG. 6, the electrical contacts are disposed as follows. The electrical contact 6*a* in the cartridge 1 side and the electrical 102*d* in the apparatus main assembly 100A side are electrically contacted to each other. The electrical contact 6*c* in the cartridge 1 side and the electrical contact 102*h* in the apparatus main assembly 100A side are electrically contacted to each other. Further, the electrical contact 6*b* in the cartridge 1 side and the electrical contact 102*e* in the apparatus main assembly 100A side are electrically contacted to each other.

In the first incompletely mounted state shown in (c) of FIG. 6, the electrical contacts are disposed as follows. The electrical contact 6*a* in the cartridge 1 side and the electrical 102*d* in the apparatus main assembly 100A side are electrically contacted to each other. The electrical contact 6*c* in the cartridge 1 side and the electrical contact 102*h* in the apparatus main assembly 100A side are electrically contacted to each other. Further, the electrical contact 6*b* in the cartridge 1 side and the electrical contact 102*f* in the apparatus main assembly 100A side are electrically contacted to each other.

In the second incompletely mounted state shown in (b) of FIG. 6, the electrical contacts are disposed as follows. The electrical contact 6*a* in the cartridge 1 side and the electrical 102*d* in the apparatus main assembly 100A side are electrically contacted to each other. The electrical contact 6*c* in the cartridge 1 side and the electrical contact 102*g* in the apparatus main assembly 100A side are electrically contacted to each other. Further, the electrical contact 6*b* in the cartridge 1 side and the electrical contact 102*e* in the apparatus main assembly 100A side are electrically contacted to each other.

Further, the cartridge 1 is inserted into the apparatus main assembly 100A and passes through the bent portions of the cartridge guides 103*a* and 103*b*. Thereafter, the cartridge 1-side electrical contact 6*a* and the apparatus main assembly 100A-side electrical contact 102*d*, and the cartridge 1-side electrical contact 6*c* and the apparatus main assembly 100A-side electrical contact 102*h* are disposed so as to be continuously electrically contacted to each other.

For this reason, after the cartridge 1 passes through the bent portions, the cartridge 1-side electrical contact 6*b* is contacted to the apparatus main assembly 100A-side electrical contacts 102*g*, 102*f* and 102*e*. As a result, it is possible to detect whether the cartridge 1 is placed in which state of the first incompletely mounted state, the second incompletely mounted state and the completely mounted state.

(Structure of Detecting Circuit of Mounted State of Cartridge)

Parts (a) to (d) of FIG. 7 are circuit diagrams for detecting the mounted state of the cartridge in this embodiment.

Part (a) of FIG. 7 shows the unmounted state of the cartridge 1, (b) of FIG. 7 shows the second incompletely mounted state of the cartridge 1, (c) of FIG. 7 shows the first incompletely mounted state, and (d) of FIG. 7 shows the completely mounted state of the cartridge 1.

In this embodiment, as a detecting system as a mounted state-detecting means for the cartridge 1, a circuit for detecting the mounted state of the cartridge 1 is provided in the apparatus main assembly 100A.

The detecting circuit is, as shown in FIG. 7, provided with the electrical contacts 102*d*, 102*e*, 102*f*, 102*g* and 102*h* in the apparatus main assembly 100A side. With the electrical contacts 102*e*, 102*f*, 102*g* and 102*h*, ends of resistors R1, R2, R3 and R4 are connected, respectively. Other ends of the resistors R1, R2, R3 and R4 are connected with a negative electrode of a DC power source 105*a*. A positive electrode of the DC power source 105*a* is connected with a terminal of a current detecting portion 105, and the other terminal of the current detecting portion 105 is connected with the electrical contact 102*d*, and is grounded via a resistor R5. Further, resistance values of the resistors R1, R2 and R3 are set so as to be different from each other.

For this reason, a detected current value is different between the case where the respective electrical contacts are connected in the completely mounted state of the cartridge 1, the case where the respective electrical contacts are connected in the second incompletely mounted state of the cartridge 1, and the case where the respective electrical contacts are connected in the first incompletely mounted state of the cartridge 1.

In the cartridge 1 side, the electrical contacts 6*a*, 6*b* and 6*c* are provided and are electrically connected with each other inside the cartridge 1. Further, the electrical contact 6*a* is connected with the photosensitive drum 2. That is, in this embodiment, as one of the electrical contacts in the cartridge 1 side, an electrode for grounding the photosensitive drum 2 is used.

In the case where the cartridge 1 is in the unmounted state, as shown in (a) of FIG. 4, all the electrical contacts are in an open state, so that the detecting circuit is not in a closed state and therefore the current does not flow through the current detecting portion 105.

In the case where the cartridge 1 is in the second incompletely mounted state, as shown in (b) of FIG. 7, the electrical contacts 6*a* and 102*d* are electrically connected with each other, the electrical contacts 6*b* and 102*g* are electrically connected with each other, and the electrical contacts 6*c* and 102*h* are electrically connected with each other. For this reason, the resistors R3 and R4 are connected in parallel, so that a value of the current passing through a combined resistor of these resistors is detected by the current detecting portion 105. Further, the photosensitive drum 2 is grounded via the resistor R5.

Further, in the case where the cartridge 1 is in the first incompletely mounted state, as shown in (c) of FIG. 7, the electrical contacts 6*a* and 102*d* are electrically connected with each other, the electrical contacts 6*b* and 102*f* are electrically connected with each other, and the electrical contacts 6*c* and 102*h* are electrically connected with each other. For this reason, the resistors R2 and R4 are connected in parallel, so that a value of the current passing through a combined resistor of these resistors is detected by the current detecting portion 105. Further, the photosensitive drum 2 is maintained in the grounded state.

On the other hand, in the case where the cartridge 1 is in the completely mounted state, as shown in (d) of FIG. 7, the electrical contacts 6*a* and 102*d* are electrically connected with each other, the electrical contacts 6*b* and 102*e* are electrically connected with each other, and the electrical contacts 6*c* and 102*h* are electrically connected with each other. For this reason, the resistors R1 and R4 are connected in parallel, so that a value of the current passing through a combined resistor of these resistors is detected by the current detecting portion 105. Further, the photosensitive drum 2 is maintained in the grounded state. Incidentally, the electrical resistance values of the resistors R1, R2 and R3 are different from each other, and therefore it is possible to detect the mounted state of the cartridge 1 by detecting the current value of the current detecting portion 105.

(Display of Warning to User)

A notifying means for notifying the state of the cartridge 1 to the user is provided. When the cartridge 1 is in the unmounted state or the incompletely mounted state, the notifying means notifies the state of the cartridge 1 by displaying warning on a displaying portion provided on an operating panel 200, so that the state of the cartridge 1 is notified to the user.

For example, in the case where the unmounting of the cartridge 1 is detected, a message to the effect that there is no cartridge and that the mounting of the cartridge 1 is urged is displayed. Further, in the case where the second incompletely mounted state of the cartridge 1 is detected, a message to the effect that the cartridge 1 is stopped in an intermediate position and that pushing-in of the cartridge 1 in the horizontal direction is urged is displayed. Further, in the case where the first incompletely mounted state of the cartridge 1 is detected, a message to the effect that the cartridge 1 is not completely mounted and that strong pushing-in of the cartridge is urged is displayed.

In this way, the mounted state of the cartridge is displayed on the operating panel 200, whereby it is possible to avoid a status in which the user does not aware of the incompletely mounted state of the cartridge 1 and discriminates that the image forming apparatus 100 causes malfunction.

Incidentally, without displaying the warning on the operating panel 200 by using the message, a light-emitting diode for the warning may also be turned on.

Further, a signal may also be sent to an external computer to display a message, on the basis of the signal, on a monitor of the computer.

Thus, in this embodiment, even in the constitution in which the cartridge guides 103*a* and 103*b* are bent, the mounted state of the cartridge 1 and the position of the cartridge 1 in the apparatus main assembly 100A are detected stepwisely, and then it is possible to give the warning to the user. For that reason, it becomes possible to improve usability during the demounting and mounting of the cartridge 1.

Further, in this embodiment, when the cartridge 1 is inserted into the apparatus main assembly 1, even in the case where the cartridge 1 is stopped in a position between the electrical contacts for detecting the mounted state of the cartridge 1, a state in which three or more electrical contacts are always connected is created. For that reason, the presence state of the cartridge 1 in the apparatus main assembly 1 can be detected with reliability, so that it becomes possible to give clear warning to the user.

Further, in this embodiment, the grounding contact originally provided on the cartridge 1 is used as the electrical contact performing not only the function as the grounding contact for the photosensitive drum 2 but also the function of detecting the mounted state of the cartridge 1, and therefore it becomes possible to reduce the number of parts (components) as the electrical contacts only used for detecting the mounted state of the cartridge 1.

(Another Constitution Example)

Another constitution example of this embodiment will be described. The electrical contacts used in this embodiment perform not only the function of detecting the mounted state of the cartridge but also the function of grounding the photosensitive drum by being connected with the photosensitive drum. However, as another example, the mounted state of the cartridge may also be detected by using, a developing contact, to be connected with the developing means, originally provided on the cartridge or by using a charging contact, to be connected with the charging means, originally provided on the cartridge.

The present invention is applicable to the image forming apparatus including the cartridge detachably mountable to the image forming apparatus.

According to the present invention, it becomes possible to detect the incompletely mounted state of the cartridge. For this reason, when the cartridge is detected as being in the incompletely mounted state, the user can receive clear instruction of an operating method and the cartridge can be moved to the incompletely mounted state without troubling the user, so that it becomes possible to improve usability.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 262016/2012 filed Nov. 30, 2012, which is hereby incorporated by reference.

What is claimed is:

1. An image forming apparatus to which a cartridge including a first cartridge contact and a second cartridge contact is detachably mountable, comprising:

a guiding member for guiding the cartridge to a positioning portion provided in a main assembly of said image forming apparatus;

a first main assembly contact contactable to the first cartridge contact when the cartridge is positioned partway toward the positioning portion and is positioned in the positioning portion;

a second main assembly contact contactable to the second cartridge contact when the cartridge is positioned partway toward the positioning portion;

a third main assembly contact contactable to the second cartridge contact only when the cartridge is positioned in the positioning portion; and detecting means for detecting presence or absence of the cartridge in the main assembly and a mounted state of the cartridge by being electrically connected with said first, second and third main assembly contacts.

2. An image forming apparatus according to claim 1, further comprising notifying means for notifying the presence or absence of the cartridge in the main assembly and the mounted state of the cartridge which are detected by said detecting means.

3. An image forming apparatus according to claim 2, wherein said notifying means notifies the presence or absence of the cartridge in the main assembly and an incompletely mounted state in which the cartridge is not positioned in the positioning portion.

4. An image forming apparatus according to claim 1, further comprising moving means for moving the cartridge to the positioning portion when said detecting means detects an incompletely mounted state in which the cartridge is not positioned in the positioning portion.

5. An image forming apparatus according to claim 1, wherein said detecting means detects the mounted state of the cartridge on the basis of a value of a current passing through a circuit connected with said first, second and third main assembly contacts.

6. An image forming apparatus according to claim 1, further comprising a fourth main assembly contact contactable to the second cartridge contact when the cartridge is positioned partway toward the positioning portion, wherein said fourth main assembly contact is provided between said second and third main assembly contacts with respect to a mounting direction in which the cartridge is to be mounted into the positioning portion, and wherein said detecting means is electrically connected with also said fourth main assembly contact and is capable of detecting a plurality of incompletely mounted states in which the cartridge is not positioned in the positioning portion.

7. An image forming apparatus according to claim 6, wherein said guiding member includes a bent portion bent with respect to the mounting direction, and wherein said third main assembly contact is provided at the bent portion.

8. A cartridge detachably mountable to an image forming apparatus, for forming an image on a recording material, including: a guiding member for guiding the cartridge to a positioning portion provided in a main assembly of the image forming apparatus; a first main assembly contact, a second main assembly contact, a third main assembly contact, and detecting means for detecting presence or absence of the cartridge in the main assembly and a mounted state of the cartridge by being electrically connected with the first, second and third main assembly contacts, said cartridge comprising:

a portion-to-be-guided for being guided by the guiding member;

a portion-to-be-positioned for being positioned at the positioning portion;

a first cartridge contact contactable to the first main assembly contact when said portion-to-be-positioned is mounted partway toward the positioning portion and is positioned in the positioning portion; and a second cartridge contact contactable to the second main assembly contact during mounting of said portion-to-be-positioned toward the positioning portion and contactable to the third main assembly contact only when said portion-to-be-positioned is positioned at the positioning portion.

9. A cartridge according to claim 8, further comprising a receiving portion for receiving a force from moving means for moving the cartridge to the positioning portion when said detecting means detects an incompletely mounted state in which the cartridge is not positioned at the positioning portion.

10. A cartridge according to claim 8, wherein when said portion-to-be-positioned is positioned partway toward the positioning portion, with respect to a mounting direction in which the cartridge is to be mounted to the positioning portion, said second cartridge contacts a fourth main assembly contact provided between the second and third main assembly contacts in the image forming apparatus.

11. A cartridge according to claim 8, further comprising:

a photosensitive drum;

charging means for electrically charging said photosensitive drum; and developing means for developing an electrostatic latent image formed on said photosensitive drum, wherein each of said first and second cartridge contacts is electrically connected with any one of said photosensitive drum, said charging means and said developing means.

* * * * *